United States Patent [19]

Burns, Sr. et al.

[11] Patent Number: 4,989,672

[45] Date of Patent: Feb. 5, 1991

[54] PACKER LOCKING APPARATUS

[75] Inventors: Timothy D. Burns, Sr.; Kenneth D. Caskey; Donald W. Winslow, all of Duncan, Okla.

[73] Assignee: Halliburton Company, Duncan, Okla.

[21] Appl. No.: 475,614

[22] Filed: Feb. 5, 1990

[51] Int. Cl.[5] ..... E21B 23/06; E21B 33/128

[52] U.S. Cl. ..... 166/196; 166/138; 166/206; 166/240; 166/387

[58] Field of Search ..... 166/138, 240, 182, 123, 166/125, 120, 387, 206, 196

[56] References Cited

U.S. PATENT DOCUMENTS

| | | | |
|---|---|---|---|
| 2,633,918 | 4/1953 | Le Rouax | 166/138 X |
| 2,871,949 | 2/1959 | Baker | 166/138 X |
| 2,886,110 | 5/1959 | Baker | 166/138 X |
| 3,398,795 | 8/1968 | Elliston | 166/138 |
| 3,608,632 | 9/1971 | Solum | 166/138 X |
| 4,018,274 | 4/1977 | Cochran | 166/129 |
| 4,131,160 | 12/1978 | Cochran | 166/182 X |
| 4,669,539 | 6/1987 | Barrington | 166/120 |

OTHER PUBLICATIONS

Halliburton Services Sales & Service Catalog No. 43, pp. 2563–2565, published in 1985.

*Primary Examiner*—Stephen J. Novosad

*Attorney, Agent, or Firm*—James R. Duzan; Neal R. Kennedy

[57] ABSTRACT

An apparatus for locking a packer against premature actuation in a well bore. The locking apparatus includes a sleeve attached to a lower end of the packer and spring biased locking members adjacent to the sleeve. When in a locked position, lugs on the locking members engage a groove in the sleeve and prevent longitudinal movement of a mandrel in the packer with respect to the packer elements. When the locking apparatus enters a liner in the well bore, the locking members are biased radially inwardly, disengaging the lugs from the groove, so that the packer mandrel may be actuated and the packer set.

20 Claims, 4 Drawing Sheets

PACKER LOCKING APPARATUS

BACKGROUND OF THE INVENTION

1. Field Of The Invention

The present invention relates to locking apparatus for downhole packers, and more particularly, to a locking apparatus which prevents premature setting of a packer by longitudinal movement of an actuating mandrel in the packer with respect to the packer elements.

2. Description Of The Prior Art

The use of packers to close off portions of a well bore is well known. Many of these packers are actuated into a set position by manipulation of the tool string. One such packer is the Halliburton Services Champ® III packer which is a multiple purpose retrievable packer designed for testing, treating and squeezing. The packer is set by turning the tool string to the right and setting down weight. The packer includes elastomeric packer elements which are squeezed outwardly into sealing engagement with the well casing by movement of an actuating mandrel connected to the tool string. Pressure applied below the packer forces hydraulic slips against the casing to prevent the packer from being pumped up the hole. A straight upward pull releases the packer. A similar packer is the Halliburton RTTS (Retrievable Test-Treat-Squeeze) packer.

When either of these packers is run into the well bore, the mandrel is held in the run-in position by interaction of a lug on the mandrel with a J-slot. Such an arrangement works well with normal, relatively undeviated well bores. However, when such packers are used in highly deviated sections of a well bore, dragging forces on the tool string resulting from contact thereof with the well bore may be enough to cause the mandrel to be prematurely actuated in the J-slot so that the packer elements are squeezed out towards their sealing position. When this occurs, the packer elements may be split because of squeezing forces on them or they may be damaged by contact with the well bore.

This damage to the packer elements may not become known until an attempt is made to set the packer, after which it is necessary to remove the tool string and replace the packer elements. Obviously, this can result in significant lost rig time. Therefore, there is a need for an apparatus to prevent such premature setting of packers.

SUMMARY OF THE INVENTION

The present invention meets the need previously described by providing a locking apparatus which holds the actuating mandrel of the packer in its run-in position relative to the outer portion of the packer including the packer elements. The packer may not be set until the locking apparatus is unlocked at a predetermined position in the well bore, such as when it enters the well liner.

The packer locking apparatus of the present invention generally comprises a sleeve connectable to an outer portion of the packer, mandrel means disposed in the sleeve for connecting to an actuating mandrel of the packer, a lock or locking member having a portion adjacent to the sleeve, a lug extending from one of the sleeve and locking member, lug receiving means on the other of the sleeve and locking member for receiving the lug therein when in a locked position such that relative longitudinal movement between the mandrel means and the sleeve is prevented, and lock disengaging means for disengaging the lug from the lug receiving means at a predetermined position in the well bore, thereby allowing relative longitudinal movement between the mandrel means and the sleeve. The locking member is longitudinally and rotatably fixed relative to the mandrel means, but may move radially with respect to the mandrel means and the sleeve.

In the preferred embodiment, the sleeve forms a portion of a drag block assembly on the packer, and the mandrel means is characterized by a lower mandrel attached to the actuating mandrel and essentially becoming part of the actuating mandrel of the packer.

The lug receiving means is preferably characterized by a groove into which the lug extends when the apparatus is in a locked position. In one embodiment, the groove is in the sleeve, and the lug extends radially outwardly from the locking member. However, the apparatus would also work if the groove were in the locking member and the lug extended radially inwardly from the sleeve into the groove.

The lock disengaging means is adapted for actuation by contact with a liner in the well bore. In the preferred embodiment, the lock disengaging means is characterized by a radially outwardly extending portion of the locking member. Contact by this outwardly extending portion with the liner will force the locking member radially inwardly to disengage the lug and lug receiving means, thus placing the apparatus in an unlocked position. Biasing means may be provided for biasing the locking member radially outwardly with respect to the mandrel means toward the locked position.

The present invention may also be said to include a downhole tool for use in a well bore comprising a packer with an outer portion having packer elements thereon and a mandrel disposed in the outer portion and attachable to a tool string, a drag block assembly connected to a lower end of the packer, generally forming a portion thereof, and further comprising J-slot means for allowing setting of the packer elements. The setting is accomplished by longitudinally raising the mandrel, rotating the mandrel with respect to the outer portion, and longitudinally lowering the mandrel such that the packer elements are set into sealing engagement with the well bore. The downhole tool also comprises a sleeve forming a lower portion of the drag block assembly and a lock disposed adjacent to a lower end of the mandrel and at least partially extending into a lower end of the sleeve, wherein one of the sleeve and the lock has a lug extending therefrom and the other of the sleeve and lock defines a groove for receiving the lug therein such that the longitudinal movement of the mandrel required for setting of the packer elements is prevented until the apparatus is at a predetermined position in the well bore. The downhole tool further comprises means for disengaging the lug and groove such that the longitudinal movement required for setting the packer is possible at this predetermine position.

It is an important object of the present invention to provide a locking apparatus for preventing premature setting of a packer in a well bore.

Another object of the invention is to provide an apparatus for locking a packer actuating mandrel with respect to an outer portion of the packer until the locking apparatus is at a predetermined position in a well bore.

Additional objects and advantages of the invention will become apparent as the following detailed description of the preferred embodiment is read in conjunction with the drawings which illustrate such preferred embodiment.

DESCRIPTION OF THE PREFERRED EMBODIMENT

Figure 1:
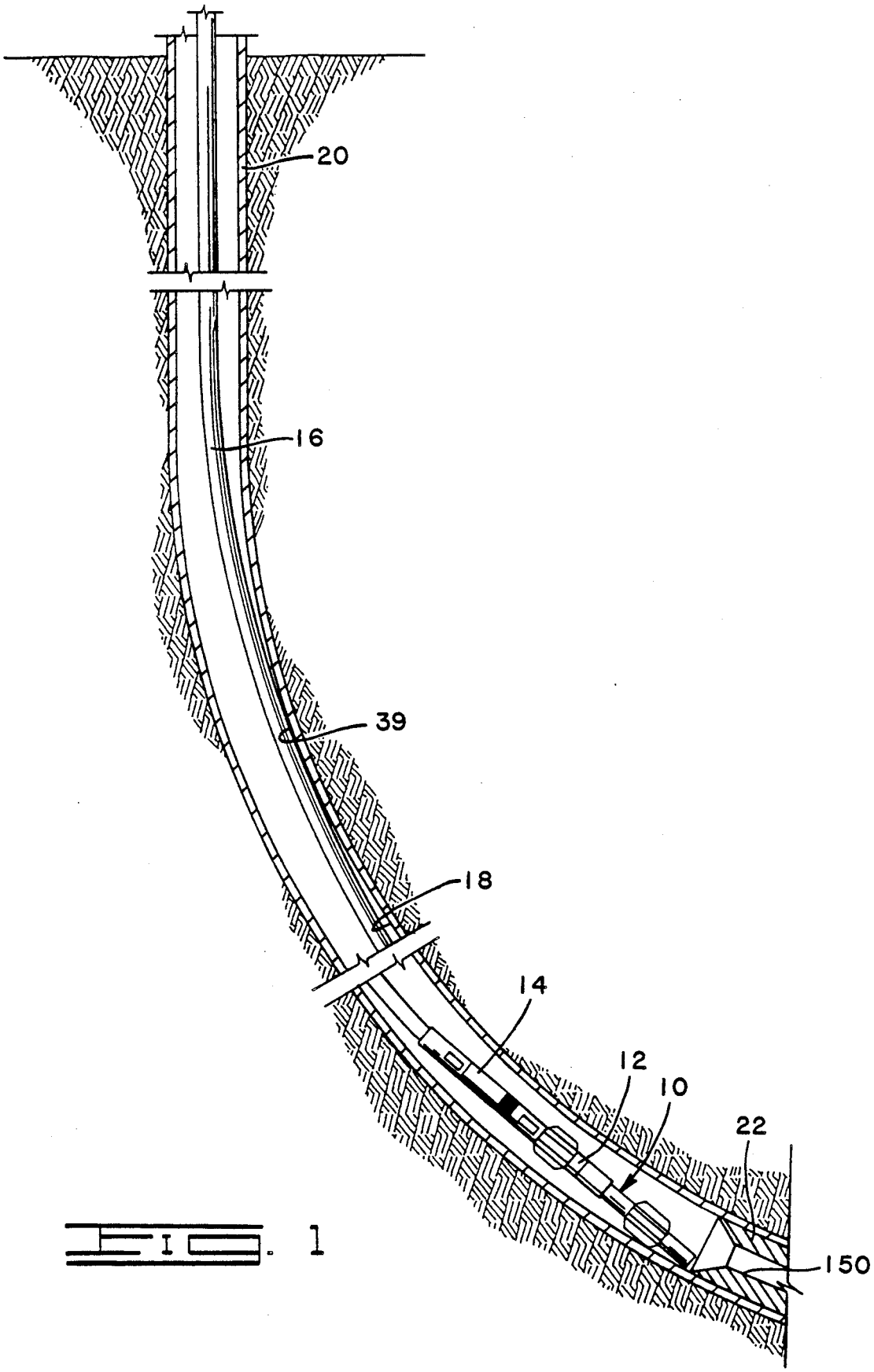
FIG. 1 illustrates the packer locking apparatus of the present invention as it is positioned in a deviated well bore with a packer at the end of a tool string.

Referring now to the drawings, and more particularly to FIG. 1, the packer locking apparatus of the present invention is shown and generally designated by the numeral 10. Locking apparatus 10 is disposed adjacent to the lower end 12 of a packer 14 which is of a kind known in the art.

Packer 14 is connected to a tool string 16, and as illustrated in FIG. 1, the entire tool string is positioned in a deviated well bore 18. Well bore 18 is typically defined by a casing 20 and a relatively smaller diameter liner 22 is disposed in well bore 18 at a predetermined location.

Figure 2A:
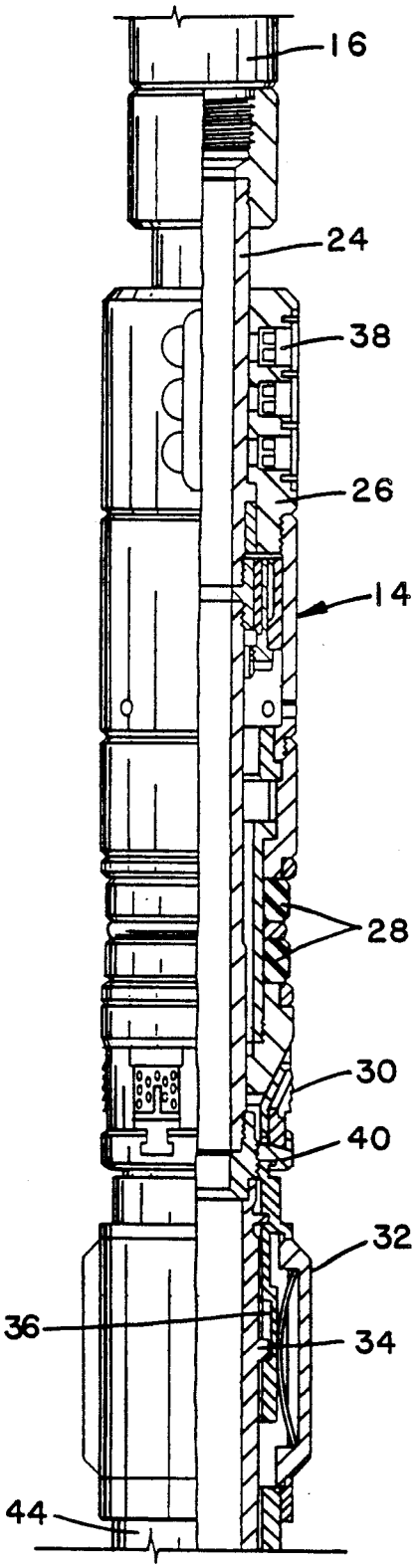
FIGS. 2A and 2B schematically illustrate a typical packer with the packer locking apparatus of the present invention connected thereto.
Figure 2B:
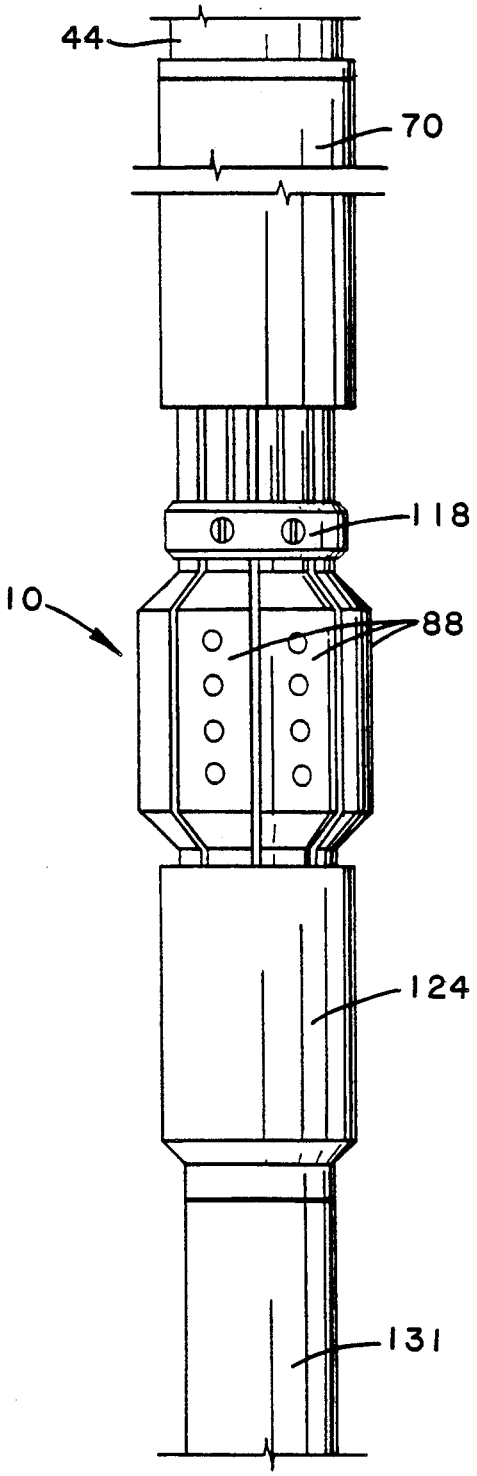

Packer 14, as already noted, is of a kind known in the art, but a general description of the operation of the packer will be presented before discussing the details of packer locking apparatus 10. Referring now to FIGS. 2A and 2B, a typical packer 14 is illustrated with locking apparatus 10 disposed therebelow. The specific packer 14 shown is the Halliburton Services Champ® III packer. Packer 14 includes an inner, actuating mandrel 24 which is connected to tool string 16. Mandrel 24 is disposed in an outer portion of packer 14, generally designated by the numeral 26. Outer portion 26 includes elastomeric packer elements 28 and slips 30. Forming part of lower end 12 of packer 14 is a drag block assembly 32. A J-slot lug 34 extends from a lower portion of mandrel assembly 24 into a J-slot 36 in drag block assembly 32 thus providing a J-slot means.

In a normal well bore, as tool string 16 is lowered into the well bore, the engagement of drag block assembly 32 with the well bore prevents premature actuation of the J-slot mechanism. Once packer 14 is in the desired position, the J-slot means may be actuated by lifting on tool string 16 and rotating to the right to move lug 34 within J-slot 36. At this point, weight can be set down on tool string 16, and mandrel 24 is free to move longitudinally downwardly with respect to outer portion 26 of packer 14. As this downward movement occurs, packer elements 28 are squeezed radially outwardly into sealing engagement with the well casing, and slips 30 are moved outwardly to grippingly engage the well casing. In the event that pressure builds up below packer 14, hydraulic slips 38 prevent the packer from being pumped up the well bore.

Packer 14 is released by a straight upward pull on tool string 16 which moves mandrel 24 longitudinally upwardly within outer portion 26. When this occurs, slips 30 are released, and packer elements 28 are disengaged from the well bore. Also, pressure is released from hydraulic slips 38.

A problem may arise when running such a packer 14 into a highly deviated well bore. Dragging of the tool string on the well bore, such as at point 39 in FIG. 1, may cause mandrel 24 to be moved relatively upwardly and rotated with respect to drag block assembly 32 sufficiently to result in premature actuation of the mechanism of the J-slot means. If such premature actuation occurs, subsequent downward load on tool string 16 will cause packer elements 28 to be prematurely squeezed outwardly. The squeezing may actually rupture the packer elements, or the packer elements may be damaged by dragging along the well bore. In addition, premature actuation of slips 30 may cause damage to the slips or result in the tool string jamming in the well bore.

Figure 3A:
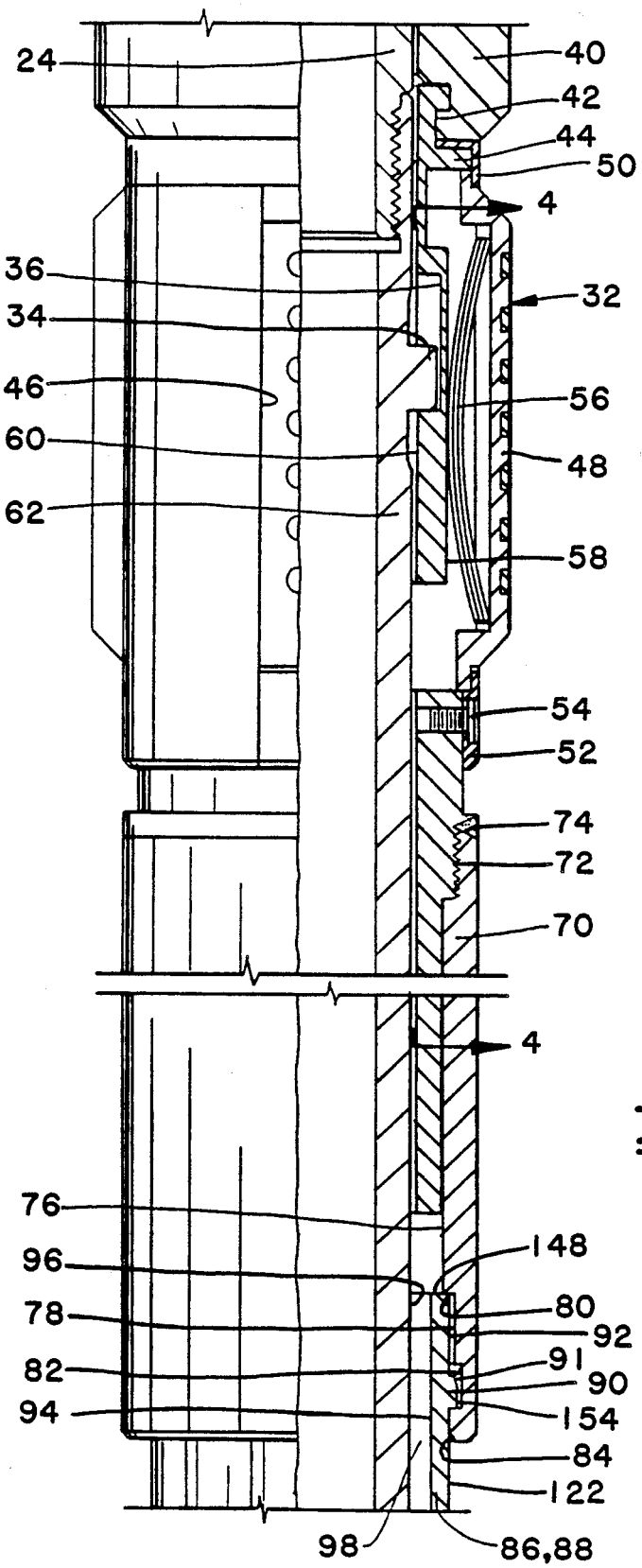
FIGS. 3A and 3B show details of the packer locking apparatus of the present invention.
Figure 3B:
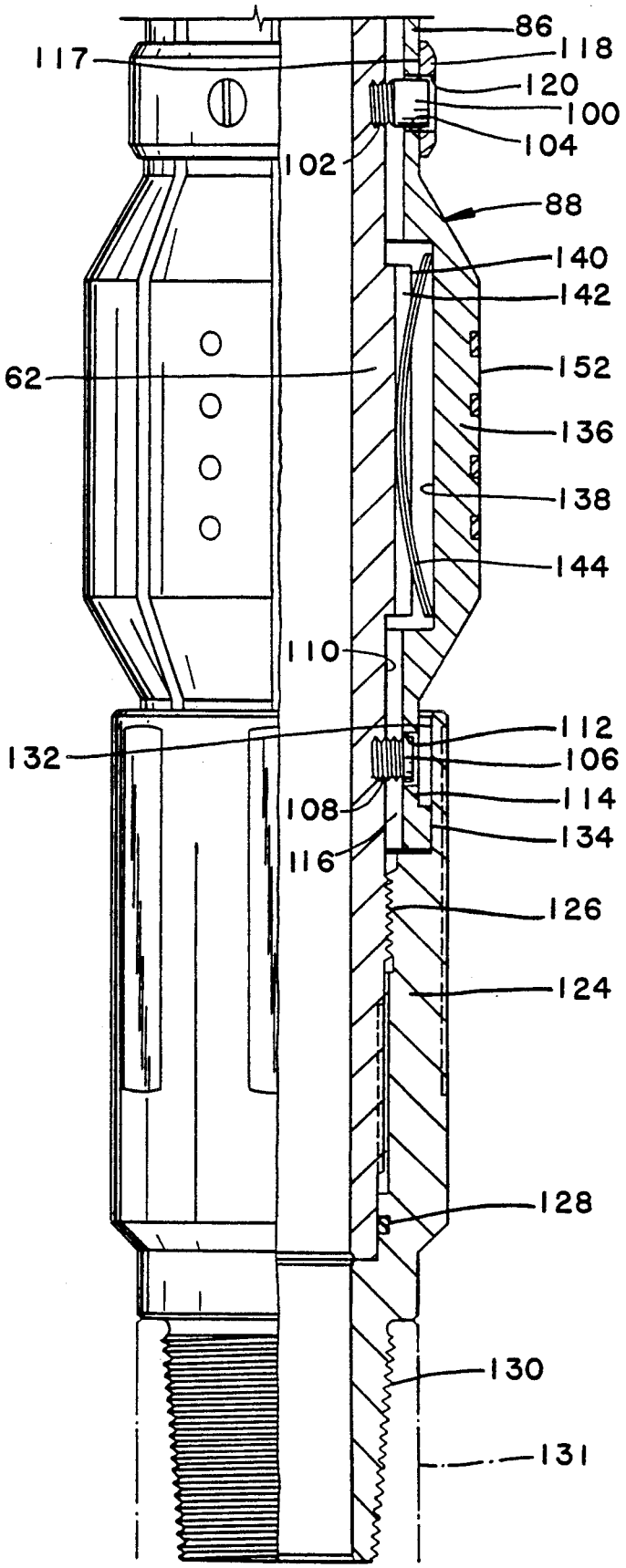

Referring now to FIGS. 3A and 3B, the details of packer locking apparatus 10 and drag block assembly 32 will be discussed.

Drag block assembly 32 is attached to the main portion of packer 14 by collar 40 which engages a groove 42 in the upper end of drag block sleeve 44. Sleeve 44 defines a plurality of elongated openings 46 therein, and a drag block 48 is disposed in each opening 46. Upper and lower drag block keepers 50 and 52 retain drag blocks 48 in the corresponding openings 46. Lower drag block keeper 52 is held in place by a bolt 54. A biasing means, such as a set of springs 56, biases each drag block 48 radially outwardly from outwardly facing surface 58 on drag block sleeve 44. It will be seen in FIG. 3A that the drag blocks 48 extend outwardly from openings 46 and thus radially outwardly with respect to packer 14.

J-slot 36 is defined in inner bore 60 of drag block sleeve 44 of drag block assembly 32. J-slot lug 34 extends radially outwardly from a mandrel means, such as lower mandrel 62, which is attached to the lower end of packer actuating mandrel assembly 24. It may also be said that lower mandrel 62 is a portion of actuating mandrel assembly 24.

Figure 4:
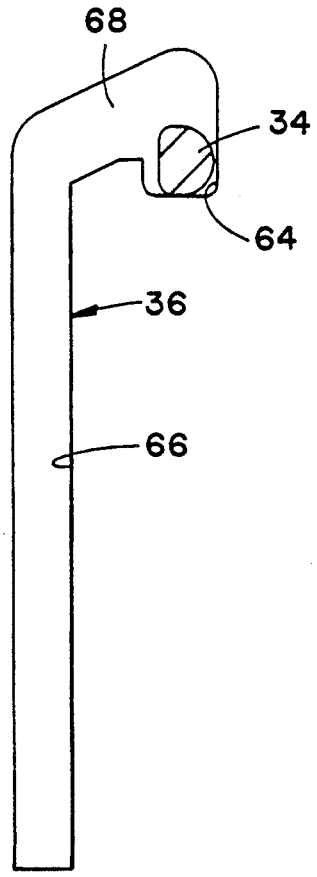
FIG. 4 is a view of a J-slot taken along lines 4—4 in FIG. 3A.

Referring now also to FIG. 4, the configuration of J-slot 36 is shown. J-slot 36 includes a short leg 64 and a long leg 66 which extends downwardly. An angled transition portion 68 interconnects short leg 64 and long leg 66. When the tool string is run into well bore 18, lug 34 is positioned in the bottom of short leg 64 of J-slot 36 as shown in FIG. 4. As will be further explained hereinafter, packer locking apparatus 10 holds lug 34 in this position so that packer 14 cannot be prematurely actuated.

Referring again to FIGS. 3A and 3B, a locking sleeve 70 is attached to the lower end of drag block sleeve 44 at threaded connection 72. Locking sleeve 70 and drag block sleeve 44 are preferably fixedly connected by a means known in the art such as a weld 74.

Locking sleeve 70 has a first bore 76 and a larger second bore 78, and a downwardly facing annular shoulder 80 interconnects the two bores. The length of locking sleeve 70 may vary depending upon the stroke necessary to actuate packer 14 into its set position.

At the lower end of locking sleeve 70, an annular groove 82 is defined in second bore 78 thereof. Below groove 82 a downwardly facing chamfer 84 is cut into second bore 78.

An upper portion 86 of a lock or locking member 88 extends at least partially into second bore 78 of locking sleeve 70. A radially outwardly extending lug 90 has a chamfer 91 on the upper edge thereof and extends from outer surface 92 of locking member 88. When in the locked position shown in FIG. 3A, the lug extends into groove 82. Locking member 88 has an inner surface 94 which is spaced radially outwardly from outer surface 96 of lower mandrel 62 such that a gap 98 is defined therebetween.

A pin 100 is attached to lower mandrel 62 at threaded connection 102 and extends radially outwardly therefrom. Pin 100 is slidably disposed in a hole 104 in upper portion 86 of locking member 88.

Similarly, another pin 106 is connected to lower mandrel 62 at threaded connection 108 and extends radially outwardly from outer surface 110 of the lower mandrel. Pin 106 is slidably disposed in a hole 112 in a lower portion 114 of locking member 88.

Lower portion 114 is spaced radially outwardly from outer surface 110 of lower mandrel 62 such that a gap 116 is defined therebetween. It will be seen that gap 116 is substantially similar to gap 98 adjacent to upper portion 86.

It will also be seen that pins 100 and 106 provide a means for preventing relative longitudinal and rotational movement between locking member 88 and lower mandrel 62. However, the pins also provide a means for allowing locking member 88 to be free to move radially with respect to lower mandrel 62. Such movement is guided by pins 100 and 106.

Preferably, a plurality of locking members 88 are circumferentially positioned around lower mandrel 62. Upper portions 86 of locking members 88 extend through and are contained by bore 117 in a lock retainer ring 118. Lock retainer 118 has a plurality of holes 120 which are substantially aligned with holes 104 in locking members 88 and receive a radially outer end of pins 100 therethrough. It will be seen that lock retainer ring 118 limits the radially outward movement of locking members 88. The radially outward movement of locking members 88 may also limited by contact of outer surface 122 of upper portion 86 with second bore 78 of locking ring 70.

A lock cap 124 is attached to the lower end of lower adapter 62 at threaded connection 126. A sealing means, such as O-ring 128, provides sealing engagement between lock cap 124 and lower mandrel 62. The lower end of lock cap 124 has an externally threaded portion 130 for connection to a lower tool string portion 131 if desired.

Lock cap 124 defines a bore 132 therein, and lower portions 114 of locking members 88 extend into bore 132. Radially outward movement of locking members 88 is limited at their lower ends by engagement of outer surface 134 of each lower portion 114 with bore 132 in lock cap 124.

Between upper portion 86 and lower portion 114, each locking member 88 has an enlarged, radially outwardly extending intermediate portion 136 which is similar to a drag block member. Intermediate portion 136 has a notch 138 therein, and a raised portion 140 of lower mandrel 62 extends into each notch 138. Raised portion 140 defines a plurality of circumferentially spaced longitudinal slots 142, each slot being generally aligned with notch 138 of a locking member 88. A biasing means, such as a set of springs 144, is disPosed in each slot 142 and contacts notch 138 of intermediate portion 136 to radially outwardly bias locking members 88 toward their radially outwardmost position shown in FIG. 3B.

OPERATION OF THE INVENTION

As tool string 16 is lowered into well bore 18, as shown in FIG. 1, the position of packer 14 will be as shown in FIG. 2A, and locking apparatus 10 will be in the locked position shown in FIGS. 3A and 3B. As previously discussed, dragging of tool string 16 on well bore 18 such as at point 39 illustrated in FIG. 1, may have a tendency to cause packer 14 to be prematurely actuated if locking apparatus 10 is not present. However, locking apparatus 10 prevents relative longitudinal movement of lower mandrel 62 with respect to drag block assembly 32, and thus prevents relative longitudinal movement of lug 34 in short leg 64 of J-slot 36 as hereinafter described.

In the run-in, locked position, locking members 88 are in their radially outwardmost position shown in FIG. 3B in which lugs 90 are engaged with groove 82 in locking sleeve 70. Because locking sleeve 70 is fixedly attached to drag block sleeve 42 and locking members 88 are longitudinally fixed with respect to lower mandrel 62 by pins 100 and 106, it will be seen that the engagement of lugs 90 with groove 82 prevent relative longitudinal movement of lower mandrel 62 with respect to drag block assembly 32. Of course, this results in prevention of relative longitudinal movement of actuating mandrel 24 with respect to outer portion 26 of packer 14, including drag block assembly 32. Thus, regardless of any dragging of tool string 16 on the wall of deviated well bore 18, locking apparatus 10 prevents premature actuation of packer 14.

As tool string 16 is run into well bore 18, shoulder 80 in locking sleeve 70 engages upper end 48 of each locking member 88. In this way, any force transmitted from locking sleeve 70 to locking members 88 is not absorbed by lugs 90 in groove 82.

When locking apparatus 10 enters liner 22 at a predetermined position in the well bore 18, inner bore 150 of liner 22 is engaged by outer surface 152 of intermediate portions 136 of locking members 88. Locking members 88 and bore 150 are sized such that this engagement will cause locking members 88 to be moved radially inwardly with respect to lower mandrel 62 such that gaps 98 and 116 are reduced and lugs 90 are disengaged from groove 82. That is, an outer end 154 of each lug 90 is spaced radially inwardly from second bore 78 of locking sleeve 70. Thus, the apparatus is in an unlocked position.

Once this unlocking operation occurs, it will be seen that the J-slot means may be actuated and lower mandrel 62 moved longitudinally with respect to drag block assembly 32. In other words, packer 14 may be set by lifting on tool string 16 which raises J-slot lug 34 in short leg 64 of J-slot 36. As this occurs, it will be seen that a portion of upper portion 86 of each locking member 88 will be moved up into first bore 76 of locking sleeve 70. By rotating tool string 16 to the right, lug 34 will be moved through transition portion 68 of J-slot 36 and aligned with long leg 66. By setting down weight on the tool string, J-slot lug 34 will move downwardly through long leg 66 of J-slot 36 which allows relative downward movement of actuating mandrel 24 within outer portion 26 of packer 14 so that the packer is set in the manner hereinbefore described.

All of the components of locking apparatus 10 with the exception of locking sleeve 70, move with lower mandrel 62. When packer 14 is released by raising tool string 16, locking members 88 will be moved upwardly toward locking sleeve 70. As upper portions 86 of locking members 88 are moved adjacent to the lower end of locking sleeve 70, chamfers 91 on lugs 90 will contact chamfer 84 in the locking sleeve. This will force locking members 88 radially inwardly. Upward movement of locking members 88 is limited by the engagement of upper end 148 with shoulder 80 in locking sleeve 70, at which point, lugs 90 will be once again aligned with groove 82.

As the tool string is raised out of well bore 18, intermediate portions 136 of locking members 88 are moved out of engagement with bore 150 in liner 22. Thus, as locking apparatus 10 exits liner 22, locking members 88 will be pushed radially outwardly to their locked position by springs 144. At this point, lugs 90 re-engage groove 82 and packer 114 is again locked against undesired actuation.

It will be seen, therefore, that the packer locking apparatus of the present invention is well adapted to carry out the ends and advantages mentioned as well as those inherent therein. While a presently preferred embodiment of the invention has been shown for the purposes of this disclosure, numerous changes in the arrangement and construction of parts may be made by those skilled in the art. All such changes are encompassed within the scope and spirit of the appended claims.

What is claimed is:

1. An apparatus for locking a packer in a run-in position and preventing premature actuation of the packer in a well bore, said apparatus comprising:

a sleeve connectable to an outer portion of said packer;

mandrel means disposed in said sleeve for connecting to an actuating mandrel of said packer;

a locking member having a portion adjacent to said sleeve, said locking member being longitudinally and rotatably fixed with respect to said mandrel means;

a lug extending from one of said sleeve and locking member;

lug receiving means on the other of said sleeve and locking member for receiving said lug therein when in a locked position such that relative longitudinal movement between said mandrel means and said sleeve is prevented; and lock disengaging means for disengaging said lug from said lug receiving means at a predetermined position in said well bore, thereby allowing relative longitudinal movement between said mandrel means and said sleeve.

2. The apparatus of claim 1 wherein said sleeve forms a portion of a drag block assembly on said packer.

3. The apparatus of claim 1 wherein said lug receiving means is characterized by a groove defined in said other of said sleeve and said locking member.

4. The apparatus of claim 3 wherein:

said groove is in said sleeve; and said lug extends radially outwardly from said locking member.

5. The apparatus of claim 1 wherein said lock disengaging means is adapted for actuation by contact with a liner in said well bore.

6. The apparatus of claim 1 wherein said lock disengaging means is characterized by a radially outwardly extending portion of said locking member.

7. The apparatus of claim 1 further comprising biasing means for biasing said locking member radially outwardly with respect to said mandrel means.

8. An apparatus for locking an actuating mandrel of a packer against relative longitudinal movement with respect to an outer portion of said packer and thereby preventing premature setting of said packer in a well bore, said apparatus comprising:

a sleeve attachable to said outer portion of said packer and extending downwardly therefrom;

a lock having an upper end extending into said sleeve, said lock being radially movable with respect to said sleeve, wherein:

one of said lock and said sleeve defines a groove therein; and the other of said lock and said sleeve defines a lug extending into said groove and preventing relative longitudinal movement between said lock and said sleeve when in a locked position;

a mandrel attachable to said actuating mandrel of said packer and extending through said sleeve adjacent to said lock; and means for preventing relative longitudinal movement between said lock and said mandrel.

9. The apparatus of claim 8 wherein:

said outer portion of said packer includes a drag block assembly; and said sleeve forms a portion of a drag block body of said drag block assembly.

10. The apparatus of claim 8 wherein:

said groove is an inwardly facing groove in said sleeve; and said lug is an outwardly extending lug on said lock.

11. The apparatus of claim 8 further comprising disengaging means for disengaging said lug from said groove such that said mandrel may be longitudinally moved with respect to said sleeve when at a predetermined position in said well bore.

12. The apparatus of claim 11 wherein said disengaging means is actuated in response to contact thereby with a well liner in said well bore.

13. The apparatus of claim 12 wherein said disengaging means is characterized by a radially outwardly extending portion of said lock, whereby said lock is moved radially inwardly when said outwardly extending portion engages said well liner.

14. The apparatus of claim 8 further comprising means for biasing said lock radially outwardly.

15. The apparatus of claim 8 wherein said lock is one of a plurality of locks circumferentially disposed around said mandrel.

16. The apparatus of claim 15 further comprising:

a lock retainer ring disposed around said upper end of each of said locks; and a cap disposed around a lower end of each of said locks.

17. The apparatus of claim 8 wherein said means for preventing relative longitudinal movement between said lock and said mandrel is characterized by a radially disposed pin attached to said mandrel and slidably disposed in a hole in said lock.

18. A downhole tool for use in a well bore comprising:

a packer comprising:

an outer portion having packer elements thereon; and a mandrel disposed in said outer portion and attachable to a tool string;

a drag block connected to a lower end of said packer and comprising J-slot means for allowing setting of said packer elements by longitudinally raising said mandrel, rotating said mandrel with respect to said outer portion, and longitudinally lowering said mandrel such that said packer elements are set into sealing engagement with said well bore;

a sleeve forming a lower end of said drag block; and a lock disposed adjacent to a lower end of said mandrel and at least partially extending into a lower end of said sleeve, one of said sleeve and said lock having a lug extending therefrom and the other of said sleeve and lock defining a groove for receiving said lug therein such that the longitudinal movement of said mandrel required for setting of said packer elements is prevented.

19. The apparatus of claim 18 further comprising means for disengaging said lug and said groove such that said longitudinal movement is possible at a predetermined position in said well bore.

20. The apparatus of claim 19 wherein said means for disengaging comprises an enlarged portion of said lock whereby said lock is displaced radially inwardly in response to contact by said enlarged portion with a liner in said well bore.

* * * * *